United States Patent [19]

Orsburn

[11] 3,934,853

[45] Jan. 27, 1976

[54] TIRE RETRIEVAL TOOL

[76] Inventor: William Orsburn, 1599 N. Norma St., Sp. 24, Ridgecrest, Calif. 93555

[22] Filed: Dec. 17, 1973

[21] Appl. No.: 425,139

[52] U.S. Cl. ..... 254/131
[51] Int. Cl.[2] ..... B66F 3/00
[58] Field of Search ..... 254/131, 120, 113, 50.1, 254/50.4; 157/1.26, 1.3; 29/267, 273

[56] References Cited

UNITED STATES PATENTS

| | | | |
|---|---|---|---|
| 951,200 | 3/1910 | Pilliner | 157/1.26 |
| 2,547,474 | 4/1951 | Munyon | 254/131 |
| 2,808,162 | 10/1957 | Hellyer | 254/131 |

*Primary Examiner*—Al Lawrence Smith
*Assistant Examiner*—Robert C. Watson
*Attorney, Agent, or Firm*—Robert M. Ashen; Robert J. Schaap

[57] ABSTRACT

A tire retrieval tool for retrieving a tire disposed in an otherwise inaccessible or difficult to reach receptacle, such as a tire well of a station wagon automobile, comprises a pair of arms joined at an elbow for applying torque to the rim of the wheel on which the tire is mounted. The arms comprise a contact member for contacting the wheel within the receptacle and a handle member for controlling and exerting force upon the contact arm. A brace attached to the arms engages the tire during retrieval thereof to prevent loss of contact between the contact member and the wheel. The handle member and the contact member are joined at an acute angle and may have different lengths to provide a mechanical advantage for facilitating retrieval of the tire from the receptacle.

2 Claims, 7 Drawing Figures

TIRE RETRIEVAL TOOL

BACKGROUND OF THE INVENTION

1. Field of the Invention

The invention relates to tools for retrieving tires from storage receptacles, particularly tire wells in motor vehicles.

2. Description of the Prior Art

The general increase of size and weight of automobiles in recent years has led to substantially increased tire sizes and weights. At the same time, there has been an increasingly compelling demand for more efficient utilization of space within automobiles, particularly in large automobiles such as station wagons. As a result of these consumer and engineering requirements, there has been an increasing trend toward placing spare tires in tire wells or receptacles located at the periphery of or at the rear of the trunks of sedans or storage spaces of station wagons. Depressed receptacles defined by the surface of the trunk or storage space are also utilized for storage of spare tires and wheels.

The combination of increased tire size and weight and decreased accessibility has produced substantial inconvenience to motorists, particularly those without sufficient strength or agility to manipulate spare tires, which frequently are relatively heavy and bulky, out of the tire receptacle. Further, the situation has resulted in injuries, including muscle strains, pulls or sprains, particularly afflicting the back region of persons attempting to manipulate a spare tire out of its well manually or with existing tools, such as jacks, with which the ordinary automobile is equipped.

Therefore, there has been a recognized but unfulfilled need for a tool permitting convenient, effective, and safe retrieval of tires from storage receptacles, particularly tire wells in automobiles.

SPECIFICATION

A tire retrieval tool comprises force exerting means including a pair of arms joined at an elbow. A first arm comprises a contact member for engaging a wheel of a tire disposed in a tire well or receptacle. The second arm comprises a handle member for manual gripping during lifting of the tire from the receptacle. The tire retrieval tool further includes a brace member or means attached to the arms. The brace means comprises an elongated member for placing in contact with the wheel to brace it and to prevent it from disengaging from the contact member upon movement of the wheel out of the tire receptacle. Portions of the brace means are configured to conform to the general configuration of the sidewalls and tread of a tire.

IN THE DRAWINGS

FIG. 1 comprises a perspective view of a tire retrieval tool in accordance with the invention;

FIG. 2 comprises a side sectional view of the tire retrieval tool of FIG. 1 aligned in initial operating position with respect to a tire to be retrieved;

FIG. 3 comprises a rear view of the tire retrieval tool and tire of FIG. 2;

FIG. 4A comprises a side view of the tire retrieval tool of FIG. 2 in initial operation position with respect to a tire to be retrieved;

FIG. 4B comprises a side view of the tire retrieval tool and tire of FIG. 4A in an intermediate operating position;

FIG. 4C comprises a side view of the items depicted in FIG. 4B in a further advanced operating position; and FIG. 4D depicts tire of FIG. 4A in a post retrieval position.

DETAILED DESCRIPTION

Figure 1:
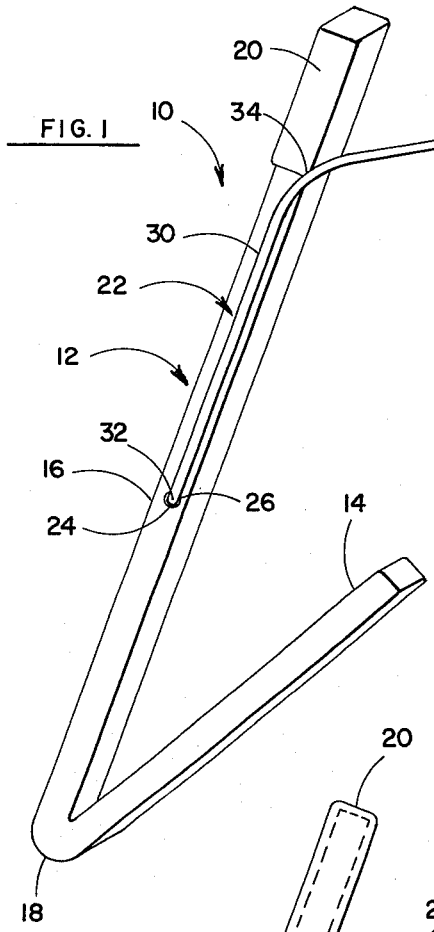
Figure 3:
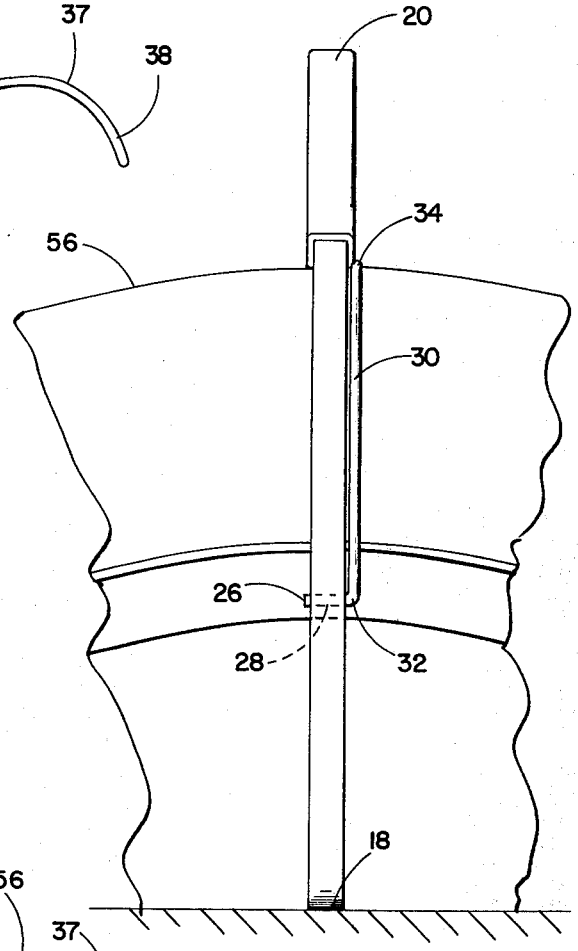

As shown in FIG. 1, a tire removal tool 10 comprises arm means 12. The arm means 12 include a first or wheel engaging member 14 and a second or handle member 16 joined to the first member 14 at an elbow 18. Preferably, members 14, 16 intersect at an acute angle, substantially equal to 30° in the depicted embodiment, at the elbow 18. Member 16 is longer than member 14 and thus provides a mechanical advantage in operating the tool 10 as further described below. Members 14, 16 are preferably integrally joined to each other, as depicted. A hand grip 20 may be attached to the handle member 14, by conventional means. Hand grip 20 is configured to accommodate the hand of a person manipulating the tool 10 and facilitates use of the tool.

Joined to the arm means 12 is brace or holding means 22. The brace means comprises a relatively thin, flexible rod preferably configured to conform generally to the contour of an ordinary automobile tire and to engage with such a tire when member 14 engages with a wheel upon which the tire is mounted. As depicted, the connection between the brace means 22 and the force exerting means 12 is preferably at the handle member 16. Connection at other points of the arm means may also be utilized in accordance with the invention. At the point of connection, the member 16 defines attaching means in the form of an aperture 24 into which an inner end 26 of an attaching segment 28 of the brace means 22 is pivotally attached. Preferably, as depicted, engagement between member 16 and segment 28 is effected by simple insertion of end 26 into aperture 24 forming a pivotable connection. In the depicted embodiment, the point of attachment between brace means 22 and member 16 is located a distance of approximately equal to three-eighths of the length of the handle member 16 from elbow 18, so as to facilitate continuing engagement of the brace means with a tire under retrieval by the tool 10, as described below. Attachment points at other locations may be employed in accordance with the invention.

An intermediate segment 30 of the brace means 22, often referred to as a "first segment" of the brace, connects to attaching segment 28 at a first joinder region 32. Segments 28, 30 preferably, as depicted, intersect at substantially a right angle, though other angles of intersection may be utilized in accordance with the invention. Segment 30 is preferably substantially linear in form; in length, segment 30 is preferably somewhat comparable to the radial extent of a tire sidewall and in a specific embodiment is substantially seven inches long. Attaching segment 28 and intermediate segment 30 may be, as depicted, integrally joined to each other.

At a joinder region 34, the intermediate segment 30 connects with a first outer segment 36. The latter segment 36, often referred to as a "first segment" of the brace, extends linearly from region 34 at an angle facilitating contact between the brace and the tire and preferably has a length substantially comparable to the span of a tire tread. In the depicted embodiment, segment 36 makes an angle with segment 30 substantially equal to 120° and the segment 36 has a length substantially equal to 6½ inches; joinder region 34 is arcuate in shape, though other configurations may be employed in accordance with the invention. At a third joinder region 37, brace segment 36 connects to a second outer segment 38, often referred to as a "third segment" of the brace, at an angle of 130°. Segment 38 and joinder region 37 are configured to conform generally to the region of a tire at which the tread and sidewall join and to an upper portion of a sidewall. Segment 38 may be rather short and need only make sufficient contact with a tire to effect operation of the tool, as described below. In a specific embodiment of the invention segment 38 is substantially equal to 2 inches in length. Moreover, in a preferred aspect of the present invention, the length of the attaching segment 28 is substantially equal to 1 inch in length. For most applications, a tool in accordance with the invention may be used with tires of various dimensions, due to the flexibility of brace means 22, which in the depicted embodiment comprises a steel rod approximately 3/16 inch in thickness. For applications of the invention in which greater adaptability is desired, joinder regions 34, 37 may be adjustable; for example, the joinder may be pivotable to adapt to tires of different types and lockable to maintain a desired configuration. For most applications, the fit between the frame means and a tire to be retrieved need not be close.

As shown in FIGS. 2–4C, the tool 10 is positionable with respect to a tire 40 so as to exert torque thereon and to lift the tire out of a well 42 or other receptacle in which it is disposed. The tire 40 and well 42 may be in the context of a conventional station wagon automobile, in which the well 42 is ordinarily disposed at the periphery of a rear storage compartment. The invention is particularly useful in such applications. This invention is applicable in other contexts as well in which tires are disposed or stored in receptacles, particularly those positioned or configured in such a manner as to make it difficult for a person unaided by the invention to exert leverage or torque upon the tire.

Figure 2:
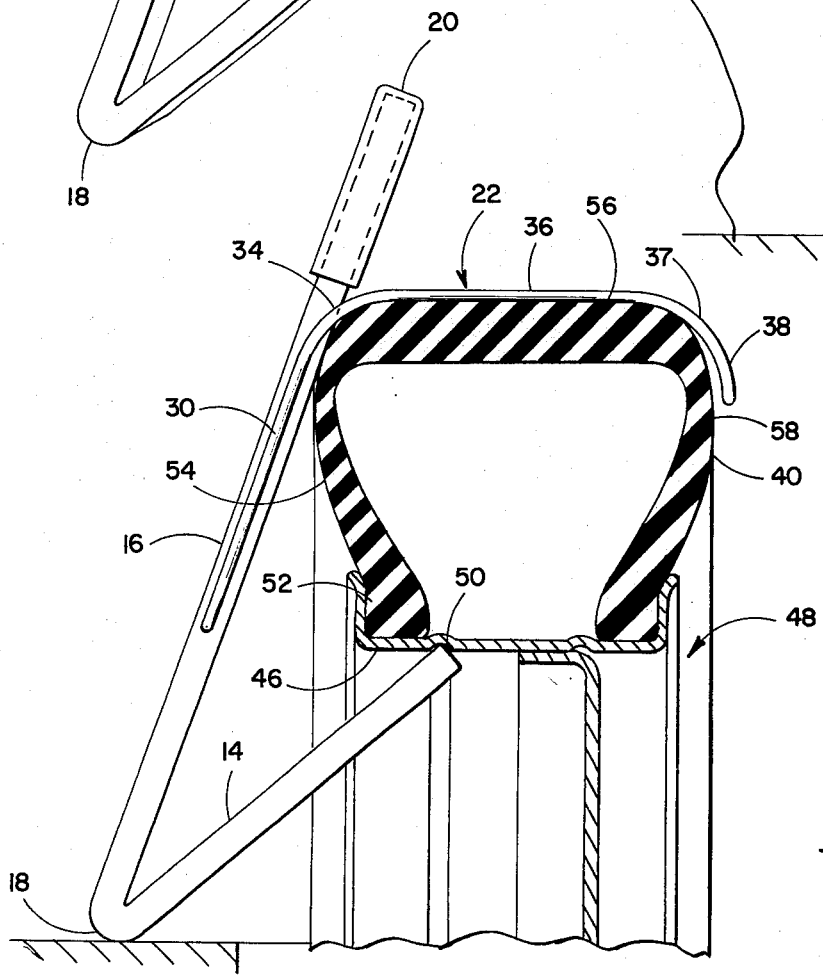
Figure 4A:
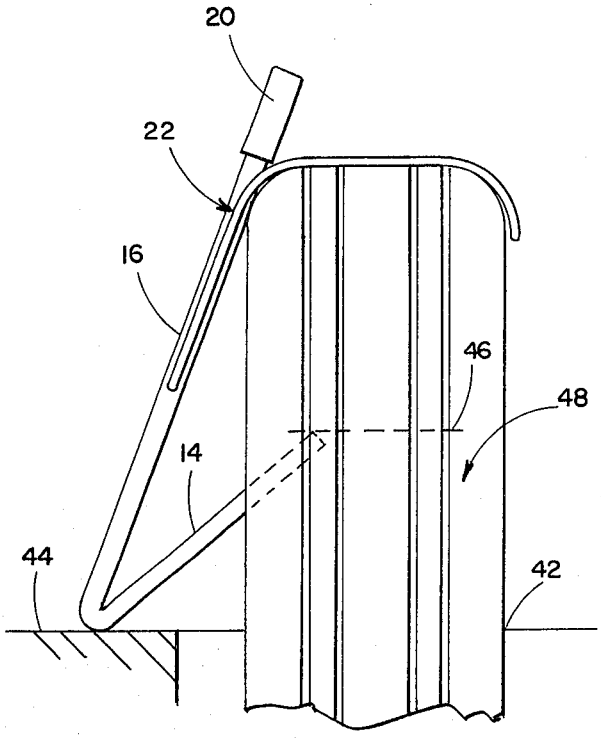

As depicted in FIGS. 2 and 4A, prior to operation, the tool 10, including the brace means 22, is positioned upon a surface 44, which may comprise the deck of a station wagon automobile, adjacent the tire 40 so that contact member 14 engages with a rim 46 of a wheel 48 (shown generally) upon which the tire 40 is mounted. Preferably, as depicted, the member 14 engages an indent 50 defined in the wheel 48 adjacent an annular bead or lip 52 of the tire 40. Brace means 22 is then pivoted to engage the tire 40. In the engaged position, the intermediate segment 30 of the brace means 22 is disposed adjacent to, and is directed toward a sidewall 54 of tire 40. Joinder region 34 is disposed adjacent the intersection of a forward upper sidewall 54 with a tire tread 56. ("Upper" is defined as "above the surface 44" and "forward" is defined as "at the same side of the tire as the tool.") The joinder region 34 is adjacent the tire 40 at the intersection of a sidewall 54 and an upper portion of the tread 56 of tire 40. Segment 36 is positioned across tread 56. Segment 38 is adjacent a rear upper sidewall 58 ("Rear" is defined as "at the opposite side of the tire from the tool") and joinder region 37 is adjacent the intersection of sidewall 58 with tread 56. The depicted rather close fit between brace means 22 and the sidewalls and tread of the tire 40 is provided only as an example of the structure and function of the invention; such a close fit is not necessary for effective use of the invention. Other fits between brace means 22 affording contact between the brace means and the tire may be utilized in accordance with the invention. For example, a fit in which contact with the tire is substantially limited to portions of segments adjacent a joinder region would permit effective use of the tool 10. In most practical applications, in which a particular tool will be provided for use with tires of particular dimensions, the depicted close fit will be utilized.

By reference to FIGS. 1 and 2 of the drawings, it can be observed that the handle member 16 is substantially longer than the wheel engaging member 14. Furthermore, the length of the wheel engaging member 14, as measured from the elbow to the upper end of the wheel engaging member 14, is greater than the length between the surface 44 and the annular wall of the rim 46. In addition, the elbow 18 engages the surface 44 at a point which is spaced outwardly from the wheel when the upper end of the arm 14 engages the annular wall of the rim 46 in order to provide a mechanical advantage in lifting the wheel from the tire well. It can also be observed that the handle member 16 with the hand grip 20 at the upper end thereof also has a greater dimension than that between the surface 44 and the uppermost surface of the tire 56.

Figure 4B:
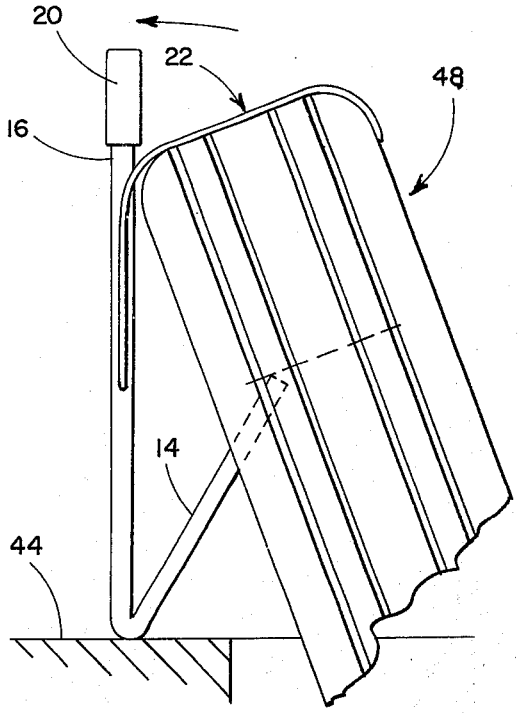

As depicted in FIG. 4B, in a second stage of operation, a force (indicated by an arrow) is manually exerted by a user (not shown) and is applied to the handle member 16 in a direction away from the tire 40 (i.e. counterclockwise as depicted) producing a torque upon the wheel 48. The torque results in angular displacement of the tool 10, together with the tire 40. Because of the greater length of the handle member 16 than the contact member 14, a mechanical advantage is obtained in exerting force upon the handle member 16 depending upon the difference in length of the members 14, 16. In many applications the difference in length may be approximately 2:1 and in a specific embodiment the handle member 12 is substantially equal to 17 inches in length and the contact member 16 is substantially equal to 8½ inches in length. Other dimensions and ratios appropriate for the requirements of specific situations may be utilized in accordance with the invention.

In operation of the tool 10, the tire 40 is prevented from displacement away from contact with contact member 14 by brace means 22. This is particularly significant while the tire 40 is being lifted out of the well, as depicted in FIG. 4B, as well as after the tire clears the well. During lifting from the well, the tire 40 will tend to tip over from the tool 10. Brace means 22 prevents such tipping from disengaging the wheel 48 from member 14. For this purpose, either a close fit or a relatively loose fit between joinder region 37 and segment 38, on the one hand, and the tire 40, on the other, will suffice. If the fit is loose, the tire will tip somewhat before being prevented from tipping further by segment 38. Thus, segment 38 need only fit closely enough to tire 40 to block tipping of the tire at a point before that point at which the tipping would cause disengagement of the wheel from the tool. In more closely fitting arrangements, of course, less tipping motion occurs before such motion is blocked. In this regard, the relationship of the point of attachment between brace means 22 and member 16 strongly influences effectiveness of the brace means. This relationship is such that when the tire contacts segment 38, the force upon the brace means resulting therefrom will not pivot the brace and permit the tire to disengage from member 14. In the depicted arrangement, tipping of the tire into contact with region 37 and segment 38 will exert negligible torque upon the brace since the force exerted upon the brace, on the whole, will be substantially collinear with lines between the point of attachment and the respective elements in contact with the tire.

Figure 4C:
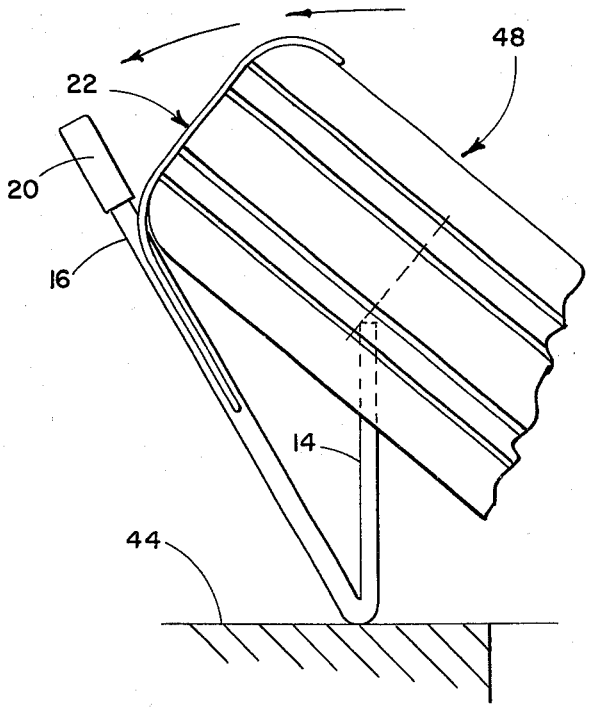

As shown in FIG. 4C, after tire 40 has been lifted clear of the well 42 and is in angular motion, brace means 22 serves to steady the tire 40 and stabilize the engagement of the wheel 48 with member 14, thus avoiding the necessity of manual intervention to effect these objectives. This avoids the inconvenience and difficulty associated with touching and manipulating a tire which is somewhat inaccessible and has tire dust and other contaminants on its surface. The relation of the point of attachment of brace means 22 to member 16 is such that the brace means has no effective tendency to pivot out of engagement with tire 40 since any pivoting by the brace toward the handle would bring the brace into contact with the tire.

Figure 4D:
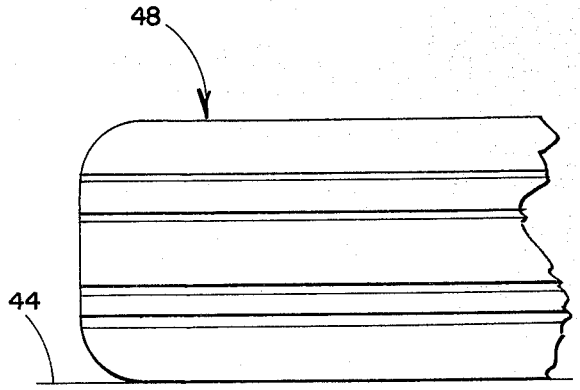

As shown in FIG. 4D, in the final position, the tire 40 rests upon its sidewall ready for use, the tool 10 having been disengaged therefrom. At the end of the path of the tool 10 and tire 40, handle member 16 rests on surface 44, and tire 40 rests upon member 16 and member 14. In this position, manual manipulation requiring little strength, skill or agility is sufficient to disengage the tire 40 from the tool 10.

Thus, effective and inexpensive apparatus for removing a heavy and bulky tire from a tire well, without requiring unusual skill, strength or agility is provided by a tire retrieval tool in accordance with the invention. Though particular embodiments of the invention have been depicted and described herein, the invention is to be defined solely by the following claims interpreted in the light of the specification.

I claim:

1. A tool for removing a tire assembly comprised of a tire mounted on a wheel from a tire well without altering the mounting of the tire on the wheel, said tool comprising a first arm manually grippable to exert manual force thereupon, a second arm for engaging the wheel of said tire assembly to be removed from the tire well, an elbow joining the first arm to the second arm at an acute angle between said first and second arms, said first arm and second arm being configured to operate as a torque-exerting member and thereby provide a mechanical advantage in exerting force upon the first arm, a tire engaging brace fixedly attached to said first arm at a point of attachment intermediate the elbow and a free end of said first arm, said brace being configured as a somewhat U-shaped member including a first segment for contacting and engaging a first sidewall of the tire, a second segment for contacting and engaging the tread of the tire, and a third segment for contacting the opposite sidewall of the tire, to thereby restrain motion otherwise tending to disengage said tire assembly from the torque-exerting member when the second arm engages the tire in a torque-exerting relationship, said third segment being substantially equal to 2 inches in length, said third segment being joined to the second segment at substantially an angle of 130°, said first segment being substantially seven inches in length, said first segment also being joined to said second segment at substantially an angle of about 120° and said second segment having a length of substantially about 6½ inches.

2. The tool of claim 1 further characterized in that the first segment is provided with an attaching segment for attachment to the first arm, and the attaching segment is joined to the first segment at an angle of substantially 90° and is substantially equal to at least 1 inch in length.

* * * * *

UNITED STATES PATENT AND TRADEMARK OFFICE

CERTIFICATE OF CORRECTION

PATENT NO. : 3,934,853

DATED : January 27, 1976

INVENTOR(S) : William Orsburn

It is certified that error appears in the above-identified patent and that said Letters Patent are hereby corrected as shown below:

Please add Claim 3 as follows:

3. A tool for removing a tire assembly comprised of a tire mounted on a wheel from a tire well, said tool comprising:

torque-exerting means including first arm means manually grippable to exert manual force thereupon, and second arm means for engaging a tire to be removed from a tire well, said first arm means and second arm means being joined to and integral with said first arm means thereby forming an elbow at a first joinder region, said first arm means and second arm means forming a rigid bar such that the first arm means comprises a first segment of the bar, and the second arm means comprises a second segment of the bar, said second arm means being configured to provide a mechanical advantage in exerting force upon the first arm means,

UNITED STATES PATENT OFFICE

CERTIFICATE OF CORRECTION

PATENT NO. : 3,934,853

DATED : January 27, 1976

INVENTOR(S) : William Orsburn

It is certified that error appears in the above-identified patent and that said Letters Patent are hereby corrected as shown below:

the ratio of length of the first arm means to the second arm means is substantially equal to 2:1, said first arm means and second arm means forming said bar forming an angle at the elbow substantially equal to 30°, means forming a first attaching aperture in the first arm means, brace means coupled to the torque-exerting means, said brace means comprising a flexible rod configured to have an inner attaching segment engageable with the attaching aperture thereby forming an attaching point where the inner segment engages the aperture, said brace means being further including a first outer segment which is joined to the intermediate segment at a second joinder region, said second joinder region and first outer segment being configured to conform generally to the intersection of the sidewall and the tread of the tire,

UNITED STATES PATENT OFFICE

CERTIFICATE OF CORRECTION

PATENT NO. : 3,934,853

DATED : January 27, 1976

INVENTOR(S) : William Orsburn

It is certified that error appears in the above-identified patent and that said Letters Patent are hereby corrected as shown below:

said second joinder region being arcuate in shape to contact at least a portion of the sidewall of said tire when the second arm means engages the tire, a second outer segment joined to the first outer segment at a third joinder region, said third joinder region and said second outer segment being configured to conform generally to the intersection of the sidewall and tread of a tire, and being positioned to contact said tire at the opposite side thereof from said first outer segment and said second joinder region, said brace means being configured to restrain motion otherwise tending to disengage said tire assembly from the torque-exerting means when the second arm means engages the wheel of said tire assembly in torque-exerting relationship, said attaching point being spaced from said elbow at a distance substantially equal to three-eighths of the length of the first arm means, said inner segment being substantially equal to

UNITED STATES PATENT OFFICE
CERTIFICATE OF CORRECTION

PATENT NO. : 3,934,853
DATED : January 27, 1976
INVENTOR(S) : William Orsburn

It is certified that error appears in the above-identified patent and that said Letters Patent are hereby corrected as shown below:

one inch in length and the inner segment being joined to the intermediate segment at substantially a right angle and said intermediate segment being substantially seven inches in length, said first outer segment being joined to the intermediate segment at substantially an angle of 120° and being substantially six and one-half inches in length, and said second outer segment being joined to said first outer segment at an angle of substantially 130° and being substantially equal to at least one inch in length.

Signed and Sealed this

Thirty-first Day of August 1976

[SEAL]

*Attest:*

RUTH C. MASON
*Attesting Officer*

C. MARSHALL DANN
*Commissioner of Patents and Trademarks*